United States Patent [19]

Reis et al.

[11] 4,037,731

[45] July 26, 1977

[54] WORKPIECE TRANSPORT APPARATUS

[75] Inventors: Walter Reis, Obernburg; Dietmar Boll, Elsenfeld, both of Germany

[73] Assignee: Walter Reis, Obernburg, Germany

[21] Appl. No.: 619,468

[22] Filed: Oct. 3, 1975

Related U.S. Application Data

[63] Continuation-in-part of Ser. No. 474,333, May 29, 1974, Pat. No. 3,924,754.

[30] Foreign Application Priority Data

May 27, 1975 Germany ..... 2523442
May 27, 1975 Germany ..... 7516833[U]

[51] Int. Cl.[2] ..... B65G 47/90

[52] U.S. Cl. ..... 214/1 BB; 214/1 BD; 214/147 T

[58] Field of Search ..... 214/1 B, 1 BS, 1 BC, 214/1 BH, 1 BD, 1 BV, 1 BB, 147 T, 1 BT, 1 CM, 146.5, 650–653

[56] References Cited

U.S. PATENT DOCUMENTS

| | | | |
|---|---|---|---|
| 3,241,687 | 3/1966 | Orloff | 214/1 CM |
| 3,314,554 | 4/1967 | Cuniberti | 214/1 Q |
| 3,394,650 | 7/1968 | Cagle | 214/1 BD X |
| 3,628,674 | 12/1971 | Koike et al. | 214/1 BD |
| 3,764,022 | 10/1973 | Ishida et al. | 214/1 BD |
| 3,765,474 | 10/1973 | Burton | 214/1 BD X |
| 3,784,031 | 1/1974 | Niitu et al. | 214/1 BD X |
| 3,851,769 | 12/1974 | Noguchi et al. | 214/1 BD X |

*Primary Examiner*—Frank E. Werner
*Attorney, Agent, or Firm*—W. G. Fasse; W. W. Roberts

[57] ABSTRACT

This apparatus relates to a workpiece transfer mechanism wherein a tiltable workpiece transfer arm has a free end. A workpiece gripping device is secured to the free end of the tiltable transfer arm by a piston cylinder arrangement. The piston rod supports the workpiece gripping device and the respective cylinder is secured to the free end of the transfer arm. The pressure in the cylinder is separately controlled on opposite sides of the piston in the cylinder to move the gripping device in response to the operation of workpiece handling stations between which the transfer mechanism is arranged. The piston is axially movable relative to the cylinder but rotation of the cylinder is transmitted to the piston to tilt the gripping device independently of any tilting of the transfer arm.

10 Claims, 4 Drawing Figures

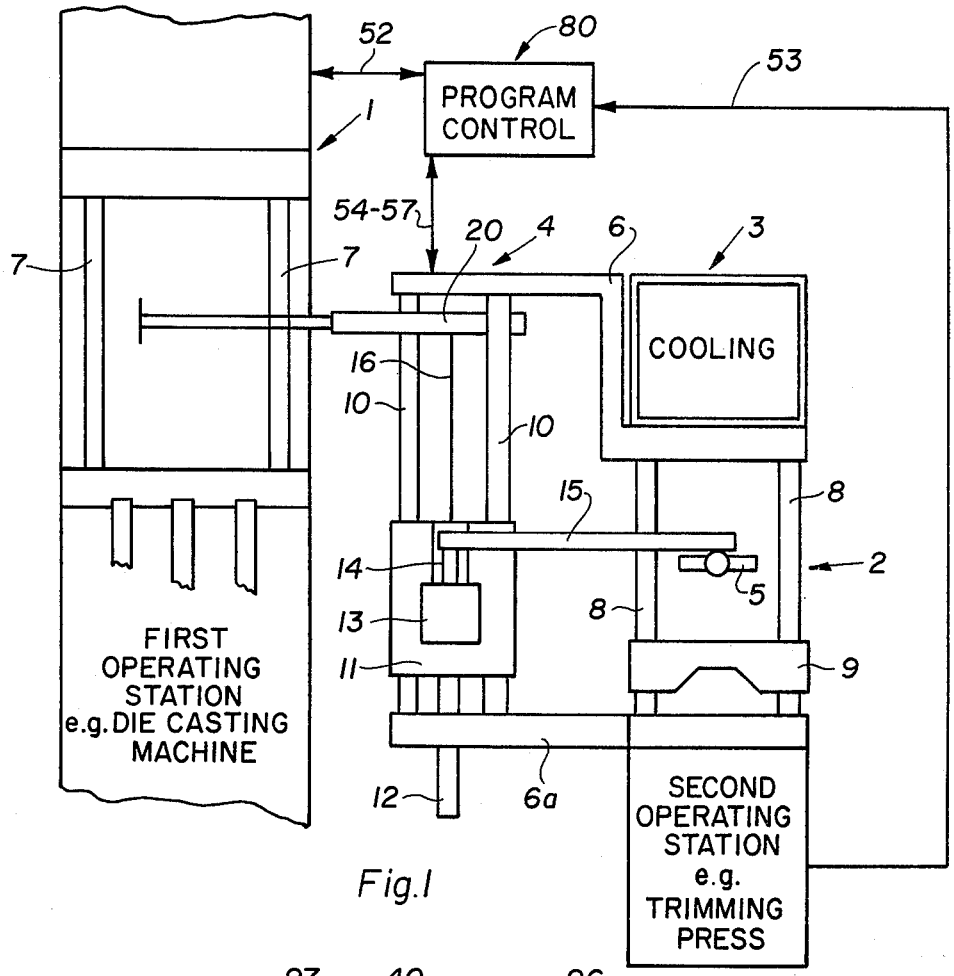
Fig.1
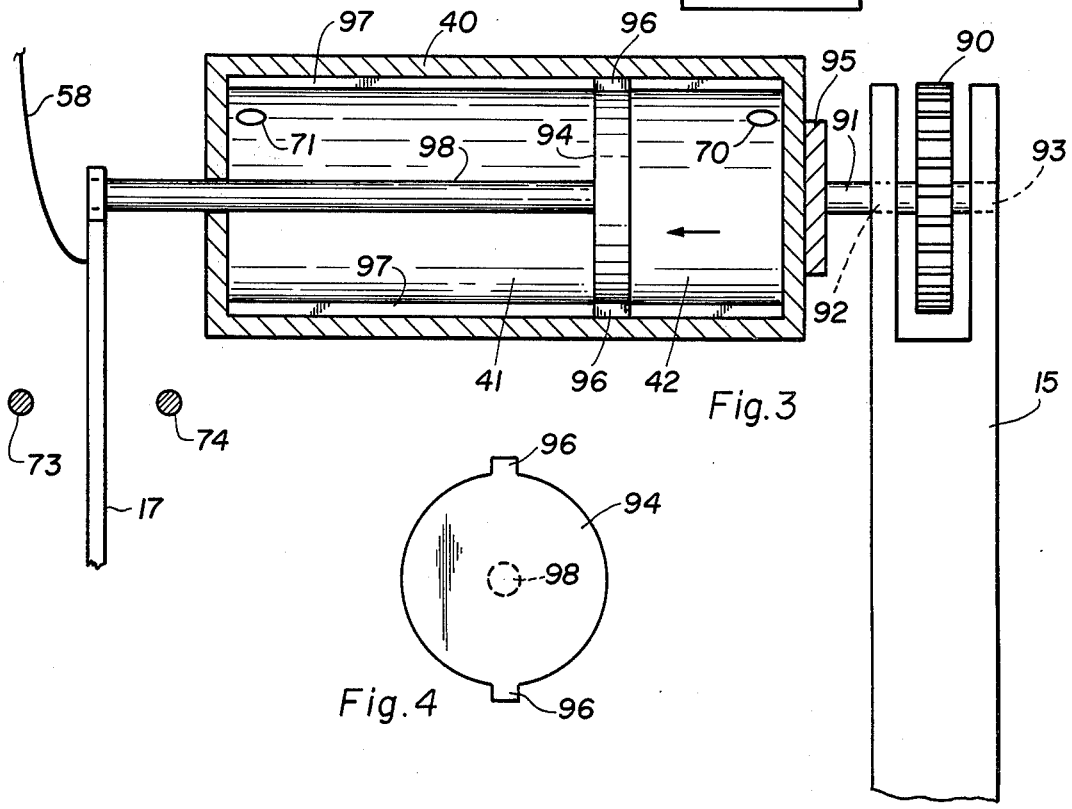
Fig.3
Fig.4

WORKPIECE TRANSPORT APPARATUS

CROSS REFERENCE TO RELATED APPLICATION

The present application is a continuation-in-part application of copending application Ser. No. 474,333 filed May 29, 1974, now U.S. Pat. No. 3,924,754, granted Dec. 9, 1975.

BACKGROUND OF THE INVENTION

The present invention relates to a workpiece transport apparatus which is employed for transferring a workpiece from one operating or work station to another work station in response to the operation of at least one of said work stations. One work station may, for example, be a pressure die casting machine and the other work station may be a trimming press. The copending application describes an apparatus in which the transport mechanism arranged between a pressure die casting machine and a trimming press, comprises a transport arm which is movable about a horizontal axis or an axis which is substantially horizontal. One end of the transport arm is journaled to said axis and the other free end of the transport arm has secured thereto a tilting arm which is movable by means of a parallel guide mechanism. The tilting arm carries workpiece gripper means and the drive means for the transport arm are arranged coaxially on said axis about which the transport arm is tiltable. If desired, the tilting arm drive means may also be arranged on said tilting axis of the transport arm.

Pressure die casting machines are equipped with one or more ejector devices for facilitating the removal of a die cast workpiece from the machine. Difficulties are encountered in removing the workpiece from a die because the cast material tends to form a burr, especially along the interface between two halves of a die. In order to reduce the burr formation it is known to employ mold dressing means. However, this has the disadvantage that a cast workpiece may drop to the ground immediately, even before the gripping means become effective, especially where mechanical gripping means are employed for the transfer of the workpiece. Thus, it has been suggested to grip a workpiece while it is still in the die, that is, prior to its ejection. To this end workpieces have been provided with a lug formed as part of the workpiece during the casting. The gripping mechanism is then able to grip the lug prior to the ejection of the workpiece from the mold. However, in order to assure that the gripping device can always precisely grip the lug, it is necessary that the latter will always be precisely in the same position. This requiement has not yet been satisfactorily met by the prior art. However, it is important that a precisely determined discharge position for the workpiece is assured at all times in order not only to facilitate the workpiece removal, but also to correctly position the workpiece in a further work station such as a trimming press. The precise positioning is also necessary for the checking of certain surface areas of the workpiece. Such surface area checks are employed for controlling the correct and complete removal of a workpiece from the die.

OBJECTS OF THE INVENTION

In view of the above, it is the aim of the present invention to achieve the following objects singly or in combination:

to assure a synchronized motion between the ejecting mechanism of one work station and the gripping device of a workpiece transfer apparatus;

to assure the maintaining of a precise take out position;

to assure such synchronization with as simple structural means as possible, whereby adverse operating conditions shall not influence the synchronization, for example, the influence of temperature changes in the pressure medium, pressure changes in the operating system, friction in the transfer mechanism, and getting stuck of the ejector device shall be minimized;

to compensate for any positional differences of a workpiece in two different stations by providing for an axial shifting of the workpiece;

to control the sequence of operation of a die casting machine and a trimming press, as well as of a workpice transfer mechanism, so that a precise timing of the operational steps relative to each other is assured;

to correlate the operational speed of an ejector mechanism, for example, in a die casting machine with the operational speed of a transfer mechanism; and to minimize the power necessary to move a gripping mechanism back and forth between two work stations.

SUMMARY OF THE INVENTION

According to the invention there is provided a workpiece transport apparatus, especially for transferring a workpiece from one work station, such as a die casting machine, into another work station, such as a trimming press. A transport arm is journaled at one end thereof to a support and drive mechanism and the free end of the transport arm carries a tilting arm including workpiece gripping means, secured to the free end of the transport arm by a piston cylinder arrangement. The cylinder is provided with two cylinder chambers separated from each other by the piston. The piston rod is connected to the tilting arm with its gripping device and the two chambers of the cylinder are connected to control means for controlling the pressure in the cylinder chambers, preferably in response to the operation of a work station or a member of a work station, such as the ejector in the mold of a die casting machine.

The combined features of the invention make it possible to assure a synchronous motion between the ejector mechanism and the gripping device of the transfer apparatus by relatively simple means, namely a piston cylinder arrangement.

According to a further feature of the invention, the control means for the piston cylinder arrangement comprise independent and separately controlled valve means for each cylinder chamber. One of these valve means releases the pressure from one of the cylinder chambers in response to retrieving a workpiece whereby such retrieving movement is greatly facilitated, because now the gripping device and with it the tilting arm and the entire piston rod to which the tilting arm is secured may be displaced in parallel in response to the force exerted by the ejector mechanism, for example, of a die casting machine. During this yielding motion, so to speak, of the gripping device, the workpiece itself is securely held by the gripping device, whereby the workpiece also follows said parallel displacement. Such parallel displacement may be even further facilitated by the second control valve means which controls the pressure supply to the other cylinder chamber. Such control is especially desirable toward the end of the parallel displacement to support such parallel displacement. These features permit the compensation of differences in the position of a workpiece in a take-up position and in a delivery position. The control of the parallel displacement may be accomplished by separate control means which in turn are responsive to a program generator or the like. Such program generator may, for example, control the die casting machine, the trimming press, and the workpiece transfer apparatus in a timed sequence.

BRIEF FIGURE DESCRIPTION

In order that the invention may be clearly understood, it will now be described, by way of example, with reference to the accompanying drawings, wherein:

FIG. 1 is a simplified plan view of a workpiece transfer mechanism arranged between a pressure die casting machine and a trimming press;

FIG. 3 shows in greater detail the piston cylinder arrangement interconnecting the transfer arm and the tiling arm; and FIG. 4 is a view in the direction of the arrow in FIG. 3.

DETAILED DESCRIPTION OF PREFERRED EXAMPLE EMBODIMENTS

Figure 2:
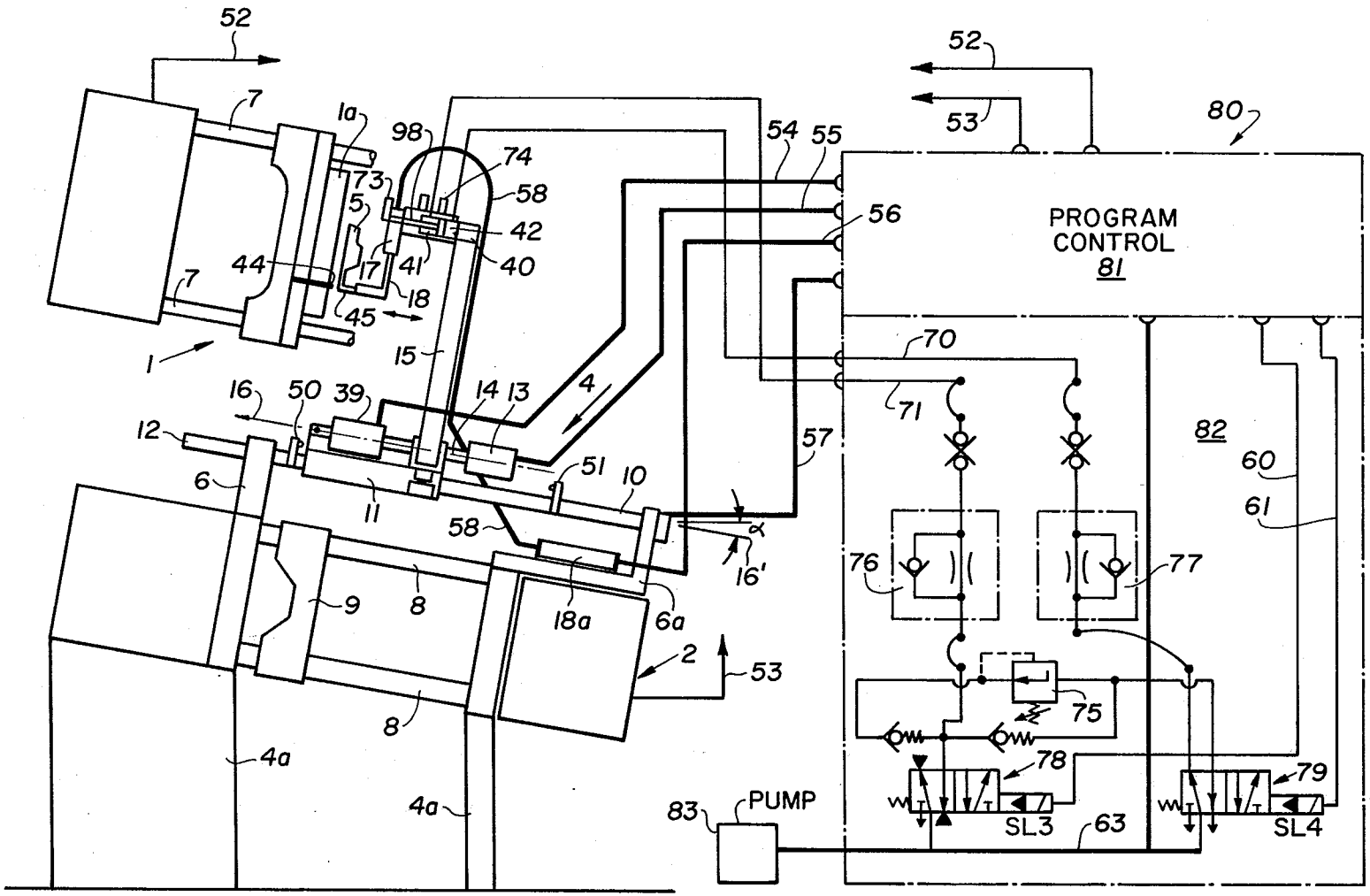
FIG. 2 is a schematic diagram illustrating a side view of the transfer mechanism and the hydraulic control circuit.

Referring to FIG. 1, there is shown a schematic plan or top view of a transport mechanism 4 arranged for cooperation with a first operating station 1 and a second operating station 2. The first operating or work station 1 may, for example, be a pressure die casting machine. The second operating or work station may, for example, be a trimming press 2. The longitudinal axes of both machines are arranged substantially in parallel to each other and are extending horizontally. In the plan view of FIG. 1 a cooling device 3 is provided for cooling the workpices. The cooling device 3 may, for example, be a dipping tank.

The present transport mechanism 4 picks up a workpiece 5 in the die casting machine and transports it into the trimming press 2. The transport apparatus 4 comprises a base frame 4*a* (FIG. 2) with side frame members 6 and 6a connected, for example, to the trimming press 2 by means of flanges not shown.

In an alternative embodiment the base frame may, for example, comprise a single upright supporting column resting on the floor of a work shop.

A program control device 80 is operatively connected to the die casting machine 1 by control lines 52 which may be realized in practice in different ways. For example, an electrical or a pneumatic or a hydraulic signal may be transmitted through the control line 52. Control lines 53 connect the trimming press to the program control 80. Here again, different kinds of signals may be transmitted. Control lines 54, 55, 56, 57 operatively interconnect the program control 80 with the transfer apparatus 4.

In the die casting machine 1 only guide columns 7 are illustrated symbolically. The trimming press 2 is also schematically shown to include guide columns 8, as well as a movable base plate 9.

The transport apparatus 4 is described in more detail in the above mentioned copending patent application. The transport apparatus comprises two guide rails 10 extending in parallel to the tilting axis 16 to be described in more detail below. The guide rails are supported between the face plates 6 and 6a. As mentioned, the guide rails 10 extend either horizontally or slightly inclined relative to the horizontal, as indicted by the angle $\alpha$ between the plane 16' defined by the guide rails 10 and the horizontal. A carriage 11 is movable back and forth on the guide rails 10. The back and forth shifting of the carriage 11 is, for example, accomplished by a hydraulic drive means 12 which may be a piston cylinder arrangement. The drive for the carriage 11 may also be an electric motor or a pneumatic drive.

The carriage 11 carries a drive device 13, for example, an electric motor having attached thereto a reduction gear box for tilting a transport arm 15 which is supported on the shaft 14 of this drive device 13. Thus, the transport arm 15 is tiltable about the axis 16 through an angle of more than 180°. The drive 13 may also be a hydraulic drive.

The carriage 11 further carries a drive device 39, such as an electric motor or a hydraulic or pneumatic drive for tilting the arm 17 through a gear and sprocket wheel drive, as described in more detail in the above copending application.

The tilting arm 17 is journaled to the free, upper end of the transport arm 15 by a shaft 40, which according to the invention is a piston cylinder arrangement as best seen in FIG. 3. A workpiece gripping device 18 is pivoted to the free end of the tilting arm 17. The gripping device 18 may comprise gripping jaws which are open and closed by their respective own drive, for example, a hydraulic drive device 18*a* operatively connected to the gripping device by conduit means 58, whereby the jaws may be opened and closed to hold the workpiece 5. For this purpose the workpiece 5 is provided with a lug 45.

As mentioned, the free end of the transport arm 15 is guided along an arc so that the jaws are moved from their shown position in the trimming press 2 to the position 20 after the opening of the pressure die casting mold where the jaws pick up a new workpiece in the open position of the mold 1a.

The tilting arm 17 carrying the gripping means 18 is tiltable independently of the transport arm 15 so that the gripping jaws may be brought into different positions depending on the shape and size of the workpiece 5. The means for transmitting the power from the drive motor 39 to the tilting arm 17 are described in more detail in the above mentioned copending patent application. According to the present improvement a link is arranged in the drive chain which permits a linear movement of the tilting arm 17 in parallel to the axis 16. This link permits in a simple manner and by simple means the transmission of an angular tilting movement and simultaneously also a linear movement.

Referring to FIG. 3, there is shown the upper portion of the transport arm 15. A sprocket wheel 90 is rigidly secured to a shaft 91 which is journaled to the upper end of the arm 15, for example, by means of bearings 92 and 93. The free end of the shaft 91 is rigidly secured to a cylinder 40 by means of a flange 95 or the like. Thus, the cylinder 40 is rotatable with the sprocket wheel 90. A piston 94 is movable back and forth in the cylinder 40 thus dividing the cylinder 40 into two cylinder chambers 41 and 42. The chamber 41 is connected to pressure control means through a hydraulic conduit 71. The chamber 42 is connected to respective pressure control means through a hydraulic conduit 70. The control means will be described in more detail below.

The piston 94 is provided with tongues 96 which are guided in grooves 97 in the inner walls of the cylinder 40. Thus, the angular movement of the cylinder 40 is transmitted to the piston 94. The piston 94 is connected with its piston rod 98 to the tilting arm 17. Thus, by controlling the pressure in the chambers 41 and 42, an axial movement will be imparted to the piston 94 and such axial movement will be transmitted to the tilting arm 17. Since the upper end of the tilting arm 17 is rigidly secured to the piston rod 98 and since the piston is rigidly connected to the cylinder against relative angular movement, the rotation of the cylinder will also be transmitted to the tilting arm 17. The extent of the axial movement may be limited by limit switches 73, 74.

Incidentally, the angle $\alpha$ indicating the tilting of the axes 16 and 16' relative to the horizontal may range from 0° to about 20°. The axial movement of the carriage 11 along the guide rails 10 is controlled by limit switches 50, 51, as is well known in the art. Similarly, it is possible to control the extent of the angular movement of the transport arm 15 by respective limit switches, whereby the tilting angle would preferably be more than 180°. The control mechanism 80 may thus be of a rather simple and hence inexpensive construction.

Referring further to FIG. 2, there is shown a control device 80 including a program control 81, a hydraulic control circuit 82 and a pressure source, such as a pump 83. The program control 81 controls the die casting machine 1, the trimming press 2, and the transport apparatus 4. The invention is not concerned with this control. The invention relates to the control of the piston cylinder arrangement 40 by means of which it is possible to transmit angular, as well as axial movement to the tilting arm 17. For this purpose the hydraulic control circuit 82 is connected to the cylinder chambers 41 and 42 by the respective conduits 70 and 71 as mentioned. Further, the hydraulic control circuit 82 is responsive to the program control 81. To this end the hydraulic control circuit 82 is connected to the program control 81 by conduits 60 and 61. The control line 54 controls the tilting drive for the cylinder 40. The control line 55 controls the tilting movement of the transport arm 15 about the drive shaft 14 of the drive means 13. The control line 56 controls the drive 18a and thus the opening and closing of the jaws 18 through the conduit 58. The limit switches 50 and 51 for limiting the extent of the horizontal displacement of the carriage 11 are also connected to the program control 81 by respective control lines not shown, which may be of an electric or hydralulic or pneumatic nature.

The control line 60 is connected to control input of a pneumatic actuator valve SL3. The control line 61 is connected to a pneumatic actuator valve SL4. The actuator SL3 actuates a control valve 78 and the actuator SL4 operates a control valve 79. These control valves 78, 79 are connected to a pressure supply line or conduit 63 and the outputs of these control valves 78, 79 are connected through choke valves 76, 77 respectively to the control conduits 70 and 71. Conduit 71 connects to the cylinder chamber 41. Conduit 70 connects to the cylinder chamber 42.

The die casting machine 1 carries a mold 1*a* on its guide rails 7. An ejector 44 extends through the mold for ejecting a workpiece 5 from the mold. The workpiece is provided with a lug 45 to be gripped by the gripping jaws 18 of the tilting arm 17. According to the invention, the arrangement is such that the jaws 18 grip the lug 45 prior to the movement of the ejector 44. As the ejector contacts the workpiece and pushes it to the right, the tilting arm 17 is able to yield to this ejecting movement, because the pressure in the cylinder chamber 42 is released through the control valve 79, which has been switched into the pressure release position through the control line 61 which in turn is responsive to the actuation of the ejector 44. The ejector actuation is part of the program control. For example, the ejector 44 may be actuated by a relay via the control conductor 52. Due to the pressure relief in the chamber 42, the ejector force may be relatively small.

After the ejector 44 has reached its extended position, the control line 60 energizes the actuator SL3 for operating the control valve 78. As a result, pressure is supplied from the pump 83 through the conduit 63, the control valve 68 and the conduit 71 to the cylinder chamber 41. This pressure supply supports the workpiece removal, axial movement of the tilting arm 17 to retrieve the workpiece 5 from the casting mold 1*a.*

The extent of the axial movement of the piston rod 98 is controlled by the limit switches 73 and 74. These limit switches are connected through conductors, not shown to the program control unit 81. Such conductors may be of the electrical, pneumatic or hydraulic type. These limit switches control through the program control 81 the actuating valves SL3 and SL4. Further, in response to the actuation of the limit switches the drive means 13 and if necessary also means 39 are either activated or deactivated via the control lines 54, 55 for tilting the transport arm 15 and, if necessary, also the tilting arm 17 to bring the workpiece 5 into the trimming press 2. For this purpose, the carriage 11 is also moved into the position shown in FIG. 1. In addition, the gripping device 18 is moved into the forward end position where it contacts the limit switch 73. This assures that the workpiece 5 is properly and securely deposited in the mold of the trimming press. Only when this is the case, will the drive means 18*a* be actuated to open the gripping jaws to release the workpiece. Incidentally, the jaws 18 are connected through the control line 58 to the drive means 18*a.* The sequence of operations can now be repeated to pick up a new workpiece from the die casting machine 1.

Summarizing, the machine performs the following sequence of steps:

1. The gripping means move in their opened condition into the pressure die casting machine 1.
2. The gripping means 18 are closed through their own drive means 18*a.*
3. The closing force of the grippng jaws is checked, for example, by checking the pressure in the control line 56 and as a result of that check a control pulse is supplied through the control line 52 to the die casting machine 1 to actuate the ejector 44, for example, by energizing a relay. The same pulse also activates the hydraulic control circuit 82, as described above for controlling the retrieval movement.
4. The ejector 44 is in its fully ejecting position whereupon it is retracted and the gripping device performs the retrieval movement. If desired, the axial movement of the piston rod 98 may be repeated in response to the retraction of the ejector 44 to make sure that the workpiece 5 is held in the correct relative position.
5. The transport apparatus moves the carriage into the position of FIG. 1 and tilts the transport arm 15 to place the workpiece 5 into the trimming press.

Incidentally, the choke valves 76, 77 permit an adjustment of the speed of the axial motion of the piston rod 98. The pressure reduction valve 75 on the other hand assures that rather little power is necessary for the axial back and forth movement of the piston rod 98.

In the light of the foregoing disclosure, it will be noted that after the workpiece 5 has been securely gripped by the jaws 18, while the workpiece is still in the mold 1*a,* the further transfer operation is controlled in response to the operation of the ejector 44 as described, whereby the entire gripping device moves axially with the ejector motion in the ejecting direction. During this workpiece withdrawing motion some low pressure is supplied to the chamber 41 to support said workpiece withdrawing motion, for example, to overcome friction forces and the like.

In order to avoid a reverse movement (toward the mold 1*a*) of the piston 94 when the ejector 44 is retracted, the pressure in the chamber 41 is increased in response to the retracting movement of the ejector 44. Thus, a fast and certain workpiece removal motion is assured while during the low pressure application, prior to the ejector retraction, to the chamber 41 a synchronous motin of the ejector 44 and the piston 94 is assured.

It is desirable to keep the length of the stroke of the piston 94 as short as possible to assure its proper guidance. In other words, the length of the piston rod 98 extending out of the end wall of the cylinder 40 should be short to provide for a mechanical advantage relative to the arm 17 which will not disturb the proper guiding of the piston rod 98. Where workpieces have a shape calling for a longer linear movement this may be accomplished by superimposing on the linear movement of the piston 94 a further linear movement for example, by means of a further piston cylinder arrangement not shown but supporting the entire tilting drive means for the arm 17 and the gripping device. By means of such an additional cylinder piston arrangement, it is possible to provide a total linear displacement corresponding to about six times the linear displacement of the piston 94. The control of the further cylinder piston arrangement would also be in response to the ejector movement. In other words, with the control of the ejector 44 the gripper and the complete axial displacement would be controlled, whereby a precise matching of the speeds is not necessary. It is merely required that the ejector movement is faster than the movement of the entire gripping arrangement in the workpiece removing direction, that is, in the ejecting direction. The low pressure movement caused by the reduced pressure in the chamber 41 assures the required synchronism between the ejector movement of the movement of the gripping means 17, 18. This automatic synchronization is assured because the axial displacement of the piston 94 under the described pressure conditions acts as a buffer between any speed differences that might exist between the speed of the gripping unit and the ejector.

Incidentally, the arrows in the control valves 78, 79 indicate the respective through-flow directions in the two possible positions of these valves.

Although the invention has been described with reference to specific example embodiments, it will be understood, that it is intended to cover all modifications and equivalents within the scope of the appended claims.

The program control 80 is of that kind, being called in prior art a stepping device. Such a program control can load one after another of the control lines 52, 53 a.s.o. in the due time sequence, whereby the sequence of the impacting of the control lines are adjustable. In like manner, any other suited program control device may be used, even a electronic computer device.

Instead of the piston cylinder means any other means for varying the distance between the transport arm and the workpiece gripping means may be used.

What is claimed is:

1. Apparatus for transporting a workpiece from one work station to another work station in response to the operation of at least one of said work stations, comprising transport means including a tranport arm, means tiltably supporting said transport arm at one end thereof for pivotal movement about a first axis, said transport arm having a free end opposite said supported end thereof, workpiece gripping means, connecting means supporting said workpiece gripping means on said free end of said transport arm for pivotal movement about a second axis parallel to and displaced from said first axis, said connecting means comprising piston cylinder means secured between said free end of the transport arm and to said gripping means for relatively displacing said workpiece gripping means with respect to said transport arm linearly along said second axis, and control means operatively connected to said piston cylinder means.

2. The apparatus according to claim 1, wherein said piston cylinder means comprise a cylinder journaled to said free end of said transport arm, a piston longitudinally movable in said cylinder and separating said cylinder into two cylinder chambers, a piston rod extending out of said cylinder, said workpiece gripping means being connected to said piston rod and means securing said piston against rotation in said cylinder.

3. The apparatus according to claim 2, wherein said control means comprise two separate, independently controllable valve means, conduit means connecting one of said valve means to one of said cylinder chambers and further conduit means connecting the other of said valve means to the other of said cylinder chambers to control the pressure in said cylinder chambers.

4. The apparatus according to claim 3, wherein one of said valve means controls the pressure release from its respective cylinder chamber, whereas the other valve means controls the pressure supply to its respective cylinder chamber.

5. The apparatus according to claim 3, further comprising valve control means connected to said valve means, program means connected to said work stations and to said transport means, and means connecting said valve control means to said program means for controlling said valve means.

6. The apparatus according to claim 3, further comprising adjustable choke valve means operatively located in said conduit means and in said further conduit means.

7. The apparatus according to claim 3, further comprising pressure reduction valve means operatively connected to at least one of said conduit means.

8. The apparatus according to claim 1, further comprising stop means positioned to limit the back and forth linear movement of said gripping means.

9. An article transport apparatus comprising a transport arm, means supporting said transport arm for pivotal movement about a first axis, means for moving said transport arm along said first axis, a tilting arm, a link linearly extensible along a second axis parallel to said first axis, said link being fixed to said tilting arm and pivotally mounted in said transport arm at a point displaced from said first axis for pivotally supporting said tilting arm for rotation about said second axis, control means connect to said link for controlling the relative displacement of said tilting arm from said transport arm along said second axis, and gripping jaw means for holding article, said gripping jaw means being connected to said tilting arm at a point thereon displaced from said second axis.

10. The article transport apparatus of claim 9, wherein said link comprises a piston/cylinder device having a piston mounted non-rotatably in a cylinder, and means for rotating said piston-cylinder device with respect to said transport arm.

* * * * *